United States Patent [19]

Beery

[11] 4,033,444

[45] July 5, 1977

[54] SYSTEM FOR EXTENDING THE LIFE OF A PIN PRINTER USING PIN SHIFTING

[75] Inventor: Jack Beery, Farmington, Mich.

[73] Assignee: Burroughs Corporation, Detroit, Mich.

[22] Filed: Jan. 20, 1976

[21] Appl. No.: 650,723

[52] U.S. Cl. ..... 197/1 R; 101/93.05

[51] Int. Cl.[2] ..... B41J 3/04

[58] Field of Search ..... 197/1 R; 101/93.04, 101/93.05; 178/30; 346/141, 1

[56] References Cited

UNITED STATES PATENTS

| | | | |
|---|---|---|---|
| 2,943,564 | 7/1960 | Demer | 101/93.05 |
| 3,814,227 | 6/1974 | Hurd | 197/1 R |
| 3,893,715 | 7/1975 | Haak | 197/1 R |
| 3,942,620 | 3/1976 | Dillinger et al. | 197/1 R |

*Primary Examiner*—J. Reed Fisher

*Attorney, Agent, or Firm*—Carl Fissell, Jr.; Edward J. Feeney, Jr.; Kevin R. Peterson

[57] ABSTRACT

A system for shifting the pins of a nine pin printing matrix printer so that the wear on the most used pin combination is distributed over the various pins in the rows and columns of pins. In the present matrix printer, the print head utilizes seven of the nine available pins for printing the character font and distributes the pin wear by causing the seven pins to be energized in a four shift pin combination; utilizing pins one through seven, then pins two through eight then, pins three through nine and then, pins two through eight. The shifting can be set to occur at the end of a sheet, page or job run. The system can be "locked up" so as to repeat one or all of the pins or to delete the use of some of the pins in the case of one or more pin failures.

10 Claims, 14 Drawing Figures

FIG. 4.
| SHIFT LOCK | INSTALL JUMPER | | | |
|---|---|---|---|---|
| | J1 | J2 | J3 | J4 |
| FIRST | | X | | |
| SECOND | X | | | |
| THIRD | | X | X | X |
FIG. 3.
| A2 | A1 | SHIFT |
|---|---|---|
| 0 | 0 | FIRST |
| 0 | 1 | SECOND |
| 1 | 0 | THIRD |
| 1 | 1 | SECOND |
FIG. 9.
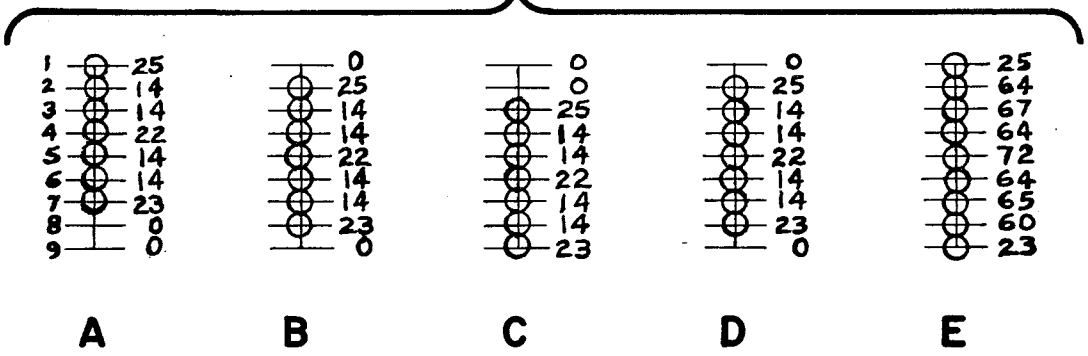
FIG. 10.
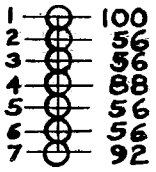

TRUTH TABLE

| A2 | A1 |
|---|---|
| 0 | 0 |
| 0 | 1 |
| 1 | 1 |

| SHIFT LOCK | INSTALL JUMPER | | | | | |
|---|---|---|---|---|---|---|
| | J1 | J2 | J3 | J4 | J5 | J6 |
| FIRST | X | | | X | | X |
| SECOND | | X | X | | | X |
| THIRD | | X | | X | X | |

SYSTEM FOR EXTENDING THE LIFE OF A PIN PRINTER USING PIN SHIFTING

BACKGROUND OF THE INVENTION

So called wire matrix printing apparatus is old and well known in the art. Such machines typically include one or more print heads, each head being provided with a plurality of printing elements, such as wires or pins, etc. Generally, the printing elements are grouped together to form a matrix such for example as four by five, five by seven or five by nine, etc., which, when energized, operate to form or print alphanumeric characters. The printing elements are selectively operable in various combinations to form the desired characters. In a typical printing system the selective operation is under the control of electromagnetic devices which in response to impulses generated by the analysis of a document or item by character generating apparatus are selectively actuated to determine or identify by their operation the combination of printing elements necessary to be moved from a print to a non-print position in order to form any particular desired alphanumeric character.

Prior to this invention, dot matrix printers, printing horizontal lines, typically used one pin and hammer arrangement for each vertical dot in a line, which results in a seven by five horizontal character being printed with a seven pin dot matrix printer. Such an arrangement typically places a high number of cycles and thus wear on the top row and the bottom row and also typically in the middle or fourth row. E, which is the most common character, best displays this wear problem of the dot matrix printer. The top, middle, and bottom row require an excessively large number of impacts to print a single character while rows two, three, five and six require only a single dot each. Other common characters in the English alphabet both alpha and numeric show similar characteristics. To improve this condition, the present invention utilizes a nine vertical pin printer used in conjunction with a seven vertical dot matrix font. Then, on alternate sets, (sheets, pages, or job runs) a different pin set can be used.

SUMMARY OF THE INVENTION

The present invention employs a nine pin printer which may be of the wire variety in which a cylindrical wire member is actuated by an electromagnet which is pulsed from a source of electrical impulses generally supplied by a ROM (read only memory) active as a character generator wherein the first word printed uses the standard pins one through seven of the nine by five matrix resulting in impacts in selected positions for each row one through five and columns one through seven. The second time a word is printed, rows two through eight are used and the number of impacts for each row are again limited as described. The impacts are the same but are one pin shifted. The third time a word is printed pins three through nine are used. In the fourth shift pins two through eight are once again actuated. By this means the total number of impacts of the various pins are distributed throughout the matrix so that neither the first nor the last nor those in between get an inordinate number of impacts.

This particular invention can be employed with any type of printing arrangement such for example as the printing or encoding on bank checks or in the endorsing of alph-numeric information on the reverse side of the check or in any instance wherein a high volume of similar type information is to be printed. Studies which are set forth in the body of the specification show that substantial improvement in life of the matrix can be obtained with this arrangement. In addition, another and important advantage of the nine pin printer matrix technique used in conjunction with a seven high pin print font is the capability of continuing to print, with the same print head, if any one of four of the nine print channels fails. In other words, if the first, second, eighth or ninth pin fails it is still possible to lock the shift line in a single position so that the seven consecutive pins that are functioning will continue to print until a replacement head or replacement part can be secured.

BRIEF DESCRIPTION OF THE DRAWINGS

FIG. 3 is the truth or function table for the logic of FIG. 2;

FIG. 4 is a fault lock chart for the present invention;

FIGS. 9*a*–9*e* are statistical illustrations of the effects of the pin shifting techniques of the invention;

FIG. 10 is a statistical summary of the impact distribution using the seven pin approach;

FIG. 12*a* illustrates the component arrangement for a three shift logic;

FIG. 12*b* is a truth table for the operation of the circuit modification of FIG. 12*a;* and FIG. 12*c* is a shift lock jumper connection table for the circuit of FIG. 12*a*.

DESCRIPTION OF THE PREFERRED EMBODIMENT

Figure 1:
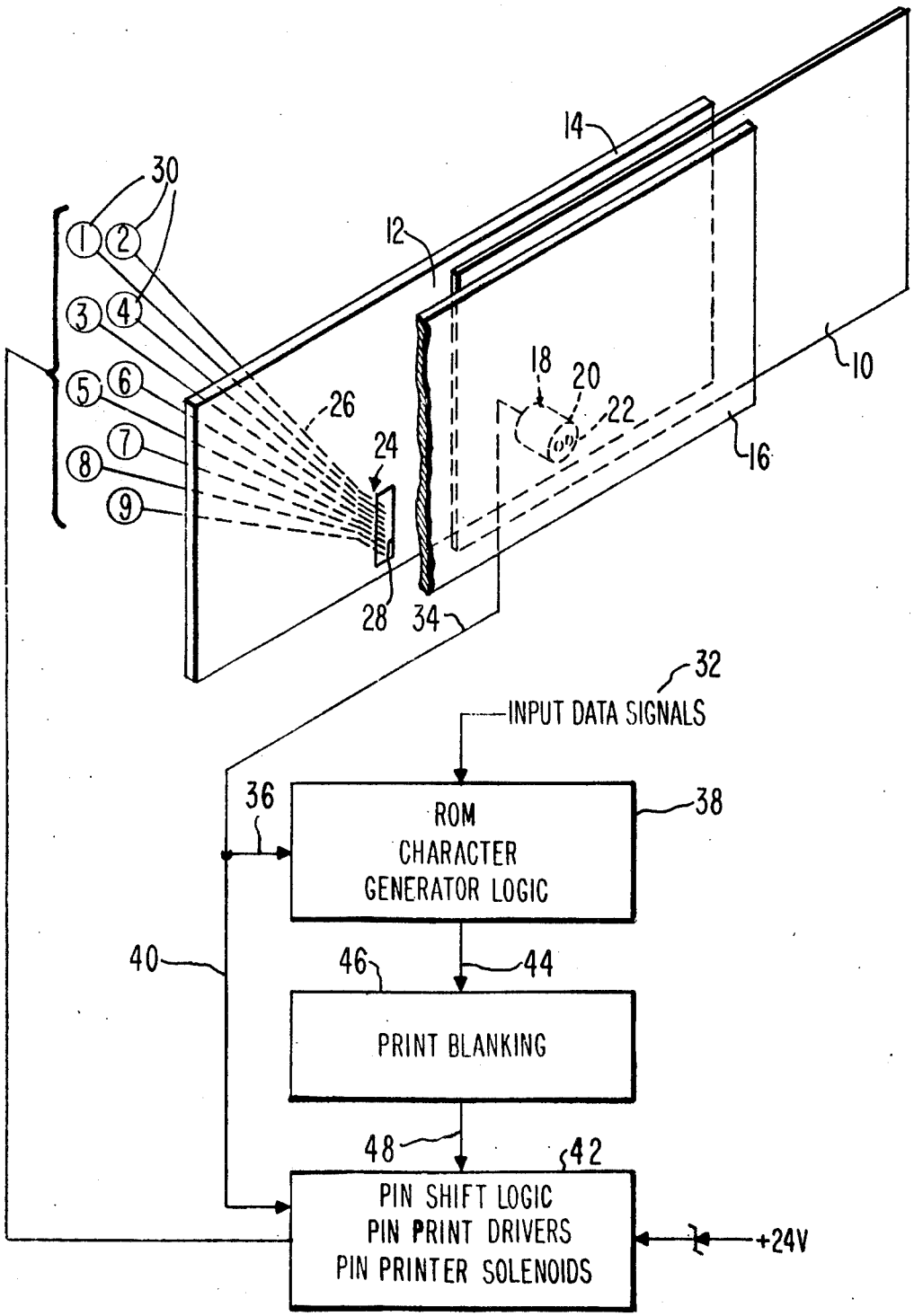
FIG. 1 is a diagrammatic representation of the present invention including a block diagram of a portion of the logic utilized therewith.

Heretofore, matrix printers of known design and implementation have been operated in conventional formats such for example as four by five, five by seven, seven by five, etc., configurations. The component parts of the apparatus including the wires or pins, actuators, etc. was cycled and recycled until the components simply wore out or were broken to be replaced by a new set of parts as required. Although it has been known from the outset that certain letters and words in the English language are used more frequently than others, and thus that certain pins or wires of a pin printer printing such words or letters tended to wear out more frequently than others in the matrix, in so far as applicant is aware, no readily available, practical solution for the wear problem has ever been proposed or implemented as completely effective.

Applicant's invention solves the problems above set forth in a new, novel and heretofore unobvious manner by utilizing an arrangement for distributing the wear over a number of components of a matrix or pin printer regardless of the words or letters being printed by shifting the pins being impacted by sheet, page and/or job run. This technique measureably lengthens the pin life and maintains the printing quality uniform over a longer period of time. In addition, by this novel apparatus and technique it is possible to keep operational a pin printing matrix when certain of the pins fail to operate for one reason or another. This is accomplished simply by "locking up" the logic for the failed pin or pins in one of three different shift positions that eliminate the pin or pins that have failed and utilizing the remaining pins for printing in the normal fashion.

In order to visualize more clearly both the problem and the solution thereto the following charts are set forth which illustrate quite clearly the distribution of wear on the pins of a typical pin matrix as well as the savings involved by such distribution.

IMPROVED PIN PRINTER LIFE UTILIZING PIN SHIFTING

The effects of using a nine pin printer and pin shifting seven pin dot matrix information to improve printer life has been evaluated. Three types of indexing were studied; shown below are the pin shifting patterns tested. Pattern C is Pattern A and Pattern B combined.

| Pin Printer | Pattern A Indexing | Pattern B Indexing | Pattern C Indexing |
|---|---|---|---|
| Row | | | |
| 1 | 1 | 1 | 1 1 |
| 2 | 2 1 | 2 1 1 | 2 2 1 1 1 |
| 3 | 3 2 1 | 3 2 2 1 | 3 3 2 2 2 1 1 |
| 4 | 4 3 2 | 4 3 3 2 | 4 4 3 3 3 2 2 |
| 5 | 5 4 3 | 5 4 4 3 | 5 5 4 4 4 3 3 |
| 6 | 6 5 4 | 6 5 5 4 | 6 6 5 5 5 4 4 |
| 7 | 7 6 5 | 7 6 6 5 | 7 7 6 6 6 5 5 |
| 8 | 7 6 | 7 7 6 | 7 7 7 6 6 |
| 9 | 7 | 7 | 7 7 |

The following is an impact study of English language alpha, equal distribution numeric, and month-day alpha numeric. While this study indicates a possible increase in life of a pin printer due to reduced impacts on the pins with high usage, the study also indicates that pin printers whose speed limiting factor is the coil temperature could achieve an increased speed by pin shifting.

ENGLISH LANGUAGE ALPHA STUDY

Alpha Frequency

The data below is based on a frequency chart for the English language from an article in the June 1966 issue of Scientific American, Page 41. This data is rounded off to the nearest 0.5%.

Alpha Frequency Table in Percent (%)

| | | | | | | | | | |
|---|---|---|---|---|---|---|---|---|---|
| A | 8 | G | 2 | L | 3.5 | Q | 0.5 | V | 1 |
| B | 1.5 | H | 6 | M | 2 | R | 7 | W | 1.5 |
| C | 3 | I | 7 | N | 7 | S | 6 | X | 0.5 |
| D | 4 | J | 0.5 | O | 8 | T | 9 | Y | 2 |
| E | 13 | K | 0.5 | P | 2 | U | 3 | Z | 0.5 |
| F | 2 | | | | | | | | |

ALPHA IMPACT DATA

| Impacts Per 1000 Characters - No Shifting | | Impacts Per 3000 Characters - Pattern A Indexing | |
|---|---|---|---|
| Pin | Impacts | Pin | Impacts |
| 1 | 2800* | 1 | 2800 |
| 2 | 1645 | 2 | 4445 |
| 3 | 1665 | 3 | 6110* |
| 4 | 2320 | 4 | 5630 |
| 5 | 1790 | 5 | 5775 |
| 6 | 1665 | 6 | 5775 |
| 7 | 2555 | 7 | 6010 |
| | | 8 | 4220 |
| | | 9 | 2555 |

-continued

| Impacts Per 4000 Characters - Pattern B Indexing | | Impacts Per 7000 Characters - Pattern C Indexing | |
|---|---|---|---|
| Pin | Impacts | Pin | Impacts |
| 1 | 2800 | 1 | 5600 |
| 2 | 7245 | 2 | 11690 |
| 3 | 7755 | 3 | 13865 |
| 4 | 7295 | 4 | 12925 |
| 5 | 8095* | 5 | 13870* |
| 6 | 7565 | 6 | 13340 |
| 7 | 7675 | 7 | 13685 |
| 8 | 6775 | 8 | 10995 |
| 9 | 2555 | 9 | 5110 |

*Indicates pin with maximum number of impacts.

Note:

(a) Alpha Impact Study based on Burroughs Printer ROM 2479 6583 dated 10/25/75.

(b) Distribution based on Alpha Frequency Chart - June 1966 issue of Scientific American, Page 41.

SUMMARY - IMPACT IMPROVEMENT
Alpha Study

| | Pattern A | Pattern B | Pattern C |
|---|---|---|---|
| Maximum Single Pin Non - Shifting Impacts (2800 Per 1000 Characters) | 8400 | 11200 | 19600 |
| Maximum Single Pin Impacts Due to Shifting | 6110 | 8095 | 13870 |
| Increased Life Based on Reduced Impacts | 37.5% | 38.4% | 41.3% |

MONTH-DAY ALPHA NUMERIC STUDY

Due to the substantially different distribution of Alpha and Numeric characters for month and day printing which is normal to endorsing, a separate study of these Alpha and Numeric characters was made with weighting based on a four year cycle.

CHARACTER WEIGHTING TABLE FOR MONTH-DAY IMPACT STUDY

| Month | Weighting Factor | Alpha Character | Weight |
|---|---|---|---|
| JAN | 31 | A | 154 |
| FEB | 28.25 | B | 28.25 |
| MAR | 31 | C | 62 |
| APR | 30 | D | 31 |
| MAY | 31 | E | 89.25 |
| JUN | 30 | F | 28.25 |
| JUL | 31 | G | 31 |
| AUG | 31 | J | 92 |
| SEP | 30 | L | 31 |
| OCT | 31 | M | 62 |
| NOV | 30 | | |
| DEC | 31 | | |

| Alpha Character | Weight | Numeric Character | Weight |
|---|---|---|---|
| N | 91 | 0 | 35.25 |
| O | 61 | 1 | 163 |
| P | 60 | 2 | 155.25 |
| R | 61 | 3 | 58 |
| S | 30 | 4 | 36 |
| T | 31 | 5 | 36 |
| U | 92 | 6 | 36 |
| V | 30 | 7 | 36 |
| Y | 31 | 8 | 36 |
| | | 9 | 35.25 |

SUMMARY IMPROVEMENT FACTOR
MONTH-DAY STUDY

| | Pattern A | Pattern B |
|---|---|---|
| Weighting Factor Alpha Characters | 8037 | 10716 |
| Weighted Impacts Alpha Characters | 6828 | 9090 |

-continued

| | | |
|---|---|---|
| Improved Life Alpha Characters | 17.7% | 17.8% |
| Weighting Factor Numeric Characters | 4393.5 | 5858 |
| Weighted Impacts Numeric Characters | 3098.5 | 4020.75 |
| Improved Life Numeric Characters | 41.8% | 45.7% |
| Weighting Factor Combined Alpha-Numeric | 12430.5 | 16574.0 |
| Weighted Impacts Combined Alpha-Numeric | 9926.5 | 12675.5 |
| Improved Life Alpha-Numeric | 25.2% | 30.8% |

Note:
(a) Alpha-Numeric study based on Burroughs Printer ROM 2479 6583 dated 10/25/74
(b) Month-Day study based on weighted distribution - four (4) year cycle
(c) Pattern C not shown as pin seven is the high impacts pin in Patterns A and B

EQUAL DISTRIBUTION NUMERIC STUDY
NUMERIC IMPACT DATA

| Impacts Per 1000 Characters - No Shifting | | Impacts Per 3000 Characters - Pattern A Indexing | | Impacts Per 4000 Characters - Pattern B Indexing | |
|---|---|---|---|---|---|
| Pin | Impacts | Pin | Impacts | Pin | Impacts |
| 1 | 2000* | 1 | 2000 | 1 | 2000 |
| 2 | 1500 | 2 | 3500 | 2 | 5500 |
| 3 | 1400 | 3 | 4900* | 3 | 6400* |
| 4 | 1500 | 4 | 4400 | 4 | 5800 |
| 5 | 1500 | 5 | 4400 | 5 | 5900 |
| 6 | 1500 | 6 | 4500 | 6 | 6000 |
| 7 | 1900 | 7 | 4900* | 7 | 6400* |
| | | 8 | 3400 | 8 | 5300 |
| | | 9 | 1900 | 9 | 1900 |

*Indicates pin with maximum number of impacts.
Note:
(a) Numeric Impacts Study based on Burroughs Printer ROM 2479 6583 dated 10/25/74.
(b) Numeric Impacts Study based on equal distribution.
(c) Pattern C not shown as pins three and seven are high impacts pins in Pattern A and B.

SUMMARY - IMPACT IMPROVEMENT
Numeric Study

| | Pattern A | Pattern B |
|---|---|---|
| Maximum Single Pin Non Shifting Impacts (2000 per 1000 Char.) | 6000 | 8000 |
| Maximum Single Pin Impacts Due to Shifting | 4900 | 6400 |
| Increased Life based on Reduced Impact (no other failure mode considered) | 22.4% | 25.0% |

The present invention is illustrated, somewhat diagrammatically, in the environment of a high speed document endorser such for example as might be utilized in a savings bank or trust department of such business. Referring first to FIG. 1, an item 10 e.g., a check having suitably disposed thereon the standard, generally used information including date, an amount, a signature and the MICR encoded data (not shown for purposes of clarity herein) is moved along a item pathway 12 delineated by side-walls 14 and 16 arranged in spaced apart parallel relationship. Wall members 14 and 16 may be part of a larger item transport assembly (not shown) including drive belts, guideways, sorting pockets and MICR encoding-reading apparatus.

Located in the item pathway 12 and suitably secured to sidewall 14, effective to produce a reflective light path across the item pathway 12 is an item or document leading edge detector 18. A light emitting diode 20, and a phototransistor 22, comprise the operating parts of the detector. Downstream therefrom (leftwardly in FIG. 1) is a printing matrix 24 arranged adjacent to side wall 14 so that the active end of each of the nine print wires or stylii 26 can be caused to be projected and retracted forwardly and rearwardly through an opening 28 in wall 14 into contact with the item or document 10 for purposes of printing suitably formulated endorsements on the items and particularly on the rear surface portion of such items. Each wire or stylus 26 is secured at its rearward end to the active element of an electromagnet or solenoid 30 (e.g., clapper or plunger), numbered one through nine inclusive as will appear more clearly hereinafter.

Document or item edge detection information in the form of electrical signals generated by detection apparatus 18 together with input data signals 32 is fed over lines 34 and 36 respectively, to a read only memory (ROM) character generator logic device 38. The document edge detection signals are also fed over line 40 to the pin shift logic device 42 (which includes the pin print drivers comprising nine high current drivers and suppression diodes) and pin printing solenoids (1–9) for actuating the nine print wires or styli to form a dot matrix character as is described further on herein.

The ROM device 28 is a specially programmed read only memory whose output polarities correspond to the firing of pin printer solenoids for a nine pin matrix (dot) printer. The memory is addressed first by a 7-bit binary address which selects the character to be printed; it is then scanned by a three-bit special pattern address that changes seven times for each character. The scanning address selects the individual rows of dots that make up the character as will be described presently.

The signals are also fed from the ROM 38 over line 44 to a print blanking device 46 and from the print blanking device over line 48 to the pin shift logic 42. The extension of line 40 from device 18 also feeds the document edge detection signal to the pin shift logic apparatus 41 as shown. The print blanking apparatus 46 comprises a circuit that disables solenoid firing as desired. Hammer or wire firing is disabled between rows of dots as the printer is cycled from one character to the next during a printing operation.

Figure 2:
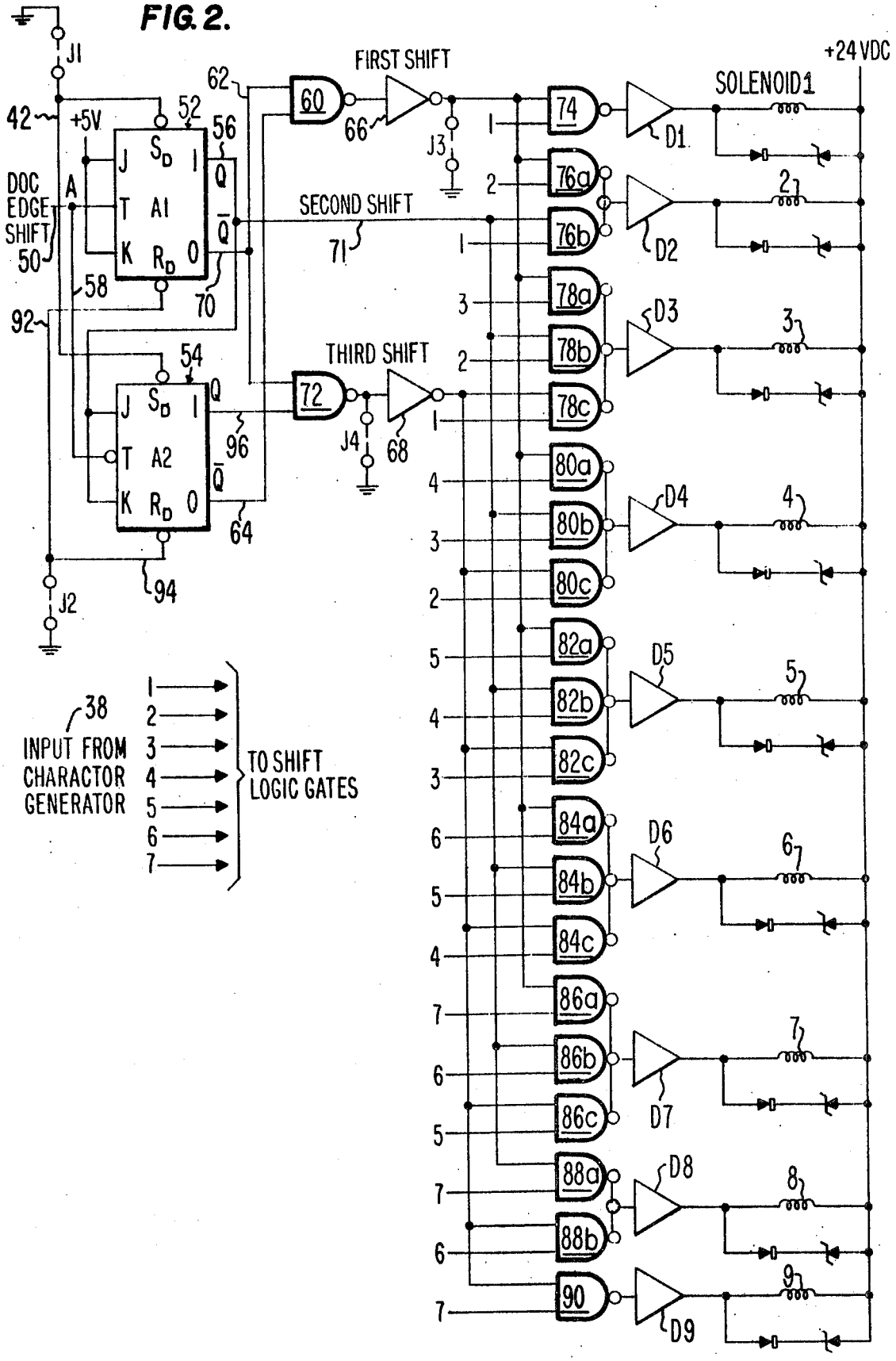
FIG. 2 is a logic diagram of the pin shifting logic of the present invention.

Referring next to FIG. 2 wherein the matrix or pin shift logic 42 for the present invention is set forth in considerable detail, it is seen that information to initiate endorsing in the form of input signal data i.e., document edge shift signals from detector 18 is fed over line 50 to a pair of flip-flops 52 and 54 (labeled A1 and A2) interconnected via lines 56 and 58. Flip-flops 52 and 54 are electrically organized and structured so as to operate in accordance with the prearranged truth table logic of FIG. 3 as will appear more clearly hereinafter as the description proceeds. All flip-flops illustrated are of the J-K type and are negative triggering on the T input and are controlled by a negative going pulse from the Doc. edge shift signal over line 50. In addition the flip-flops are of a type commonly known as master-slave devices. This is important as the dominant Set labeled $S_d$ and the dominant Reset labeled $R_d$ when used will over-ride the inputs from the J-K operation. Essentially they will ignore the triggering. DTL logic is used but is not the only logic that is available. All the logic gates are positive NAND — with the exception of the two inverters used on the first and third shift, described hereinafter. Thus the output of the NAND gate will be positive unless all the inputs are positive, i.e., for an output signal from a NAND gate to be zero, all the inputs must be one or true.

The shifting of the pin printer is controlled by a document passing the phototransistor device 18 giving a negative going pulse to the Doc Edge Shift input 50 of flip-flops 52 and 54 via Node A to the T input of 52 and the T input of 54. This trigger input will cause the flip-flops to change states when a logical one or a +5 volts signal is on the J-K input. Note that the J and K inputs of both flip flops are both tied together. In the case of A-1 they are tied at logic level one or 30 5 VDC causing each Doc edge shift to change the state of A-l. This can be seen in FIG. 3 where it continuously changes 0101. Flip-flop 54 or A-2 alternately has logical one (+5 VDC) on the J-K inputs and logical zero (Zero VDC) on the J-K input via lead 56 from the one output of flip-flop 52. When the one output is at logical 0, the next shift will not triggger A-2. Observe FIG. 3 where the signal under A-1 is zero, the next signal at A-2 is the same as the previous signal. However, when there is a one (1) on line A-1, flip-flop A-2 changes states. This then causes A-2 to shift every other pulse. An exception to the control of the Doc Edge Shift pulse is when the dominant Set or the dominant Re-set of a flip-flop is grounded or at logic 9. When a logic 0 is impressed on a dominant Set or dominant Re-set, the T input will not function. This condition allows the shift lock to work as will be described later on hererin, as shown in FIG. 4.

Flip-flops 52 and 54 generate the signals to the first shift line, the second shift line, and the third shift line (upper center FIG. 2). They are generated to the first line through NAND gate 60 over leads 62 and 64 by their connection to the zero output also called $\overline{Q}$. With five volts or logical 1 impressed on each of the lines into NAND gate 60, the output is at logic 0 (zero volts) causing the output through inverter 66 to be Logic 1 (+5 VDC). It should be noted at this time that the second shift voltage is at zero and the third shift voltage on the output of inverter 68 is also at zero. Where the outputs of NAND gates are wired together, typically three NAND gates together, they are characterized herein as "wired or's s" because if any one of the outputs are at ground all the outputs are at ground. With output of inverter 66 connecting inverters to drivers D1 through D7 through NAND gates 74, 76*a* 78*a*, 80*a*, 82*a*, 84*a* and 86*d* together being Logic 1 (+5 VDC), the conditions are set for solenoids one through seven to be energized when the input from the character generator ROM 38 are through the print blanking 46 at Logic 1. Now with the next Doc Edge Shift pulse flip-flop 52 will go true making the Q output line 56 go to logical one or +5 VDC and the zero output of the $\overline{Q}$ side, line 70, go to zero volts. With flip-flop A-1 true, the second shift via line 71 sets up solenoids two through eight to fire (again only when inputs from the character generator ROM 38 through the print blanking 46 are at logic 1). Note that the status of A-2 is immaterial. Flip-flop A-2 state has no effect on the second shift pulse as the second shift comes into play whenever flip-flop A-1 output Q is true, thus the second shift status is utilized two times through each complete cycle of flip-flops A-1 and A-2. With the next Doc Edge Shift pulse, both flip-flops change states as the J-K input to A-2 was at logic 1 (+5 VDC). Under this circumstance the $\overline{Q}$ side of 52 and the Q side of 54 are at logic 1 (+5 VDC). This condition causes the output of NAND gate 72 to go to Logic 0 or zero volts as both its inputs are at logic 1 (+5 VDC). With the output of 72 going to zero volts the inverter 68 output is at logic 1 (+5 VDC) causing its output to set the condition to fire solenoids three through nine. The next Doc Edge Pulse will change the state of flip flop 52 only. This condition will cause the second shift pulse to again be at +5 VDC while the outputs of inverters 66 and 68 will be at zero or logical zero. With the foregoing there has now been described at first, second, third, second shift operation and the next shift will take up to the top of the register 00 or a first shift pulse. In the case of the solenoid drivers D1–D9 a ground signal (a logic zero) on the input of the driver will cause the associated solenoid to fire. A high signal-plus five volts (a logical one) on the input to that driver wil hold the solenoid off.

In the case of a failure of pins one, two eight or nine, steps can be taken to lock the mechanism. First will be described the locking mechanism when pin (one and two) or (one and two) would fail. In this condition, observing FIG. 4, jumpers would be installed on points J-2. This jumper would transmit a low or logical zero to the dominant reset input of the master/slave slave J-K flip-flops A-1 and A-2 over lines 92 and 94 causing the flip-flops to dominantly reset and preventing any Doc Edge Shift Pulse from changing the states of those flip-flops. When the dominant reset goes low, the $\overline{Q}$ side of flip-flops 52 and 54 go high or to logical 1 or to +5 VDC. With this step there is a logic 1 or +5 VDC on each input of NAND gate 60 which make its output go low and through the inverter 66 causes the output of the inverter 66 to be high. Normally this would set up a first shift condition, however, the jumper J3 is installed which ties the first shift low preventing it from being operable. On the other hand, NAND gate 72 has a low input via line 96 causing the output of 72 to be at logical one or high. This then must be tied through jumper J-4 to ground to drive the output low and cause the output of inverter 68 to be high. With inverter 68 high we are in the third shift position. It can be seen that the removal of jumpers J-3 and J-4 will cause a change to the first shift condition and will eliminate a third shift condition. However, for a second shift jumper J-1 is installed which dominantly sets flipflops A-1 and A-2 causing the Q side to be at +5 VDC and the $\overline{Q}$ side to be low or at ground. Under this condition, first and third shift are made inoperable as the outputs of both these inverters are at ground. The second shift which is connected to the Q output of A-1 is a logic 1 (+5 VDC) and is now operable. Under this condition (second shift) we can have a failure in pin one, pin nine or pin one and pin nine.

Figures 5, 6, 7, 8:
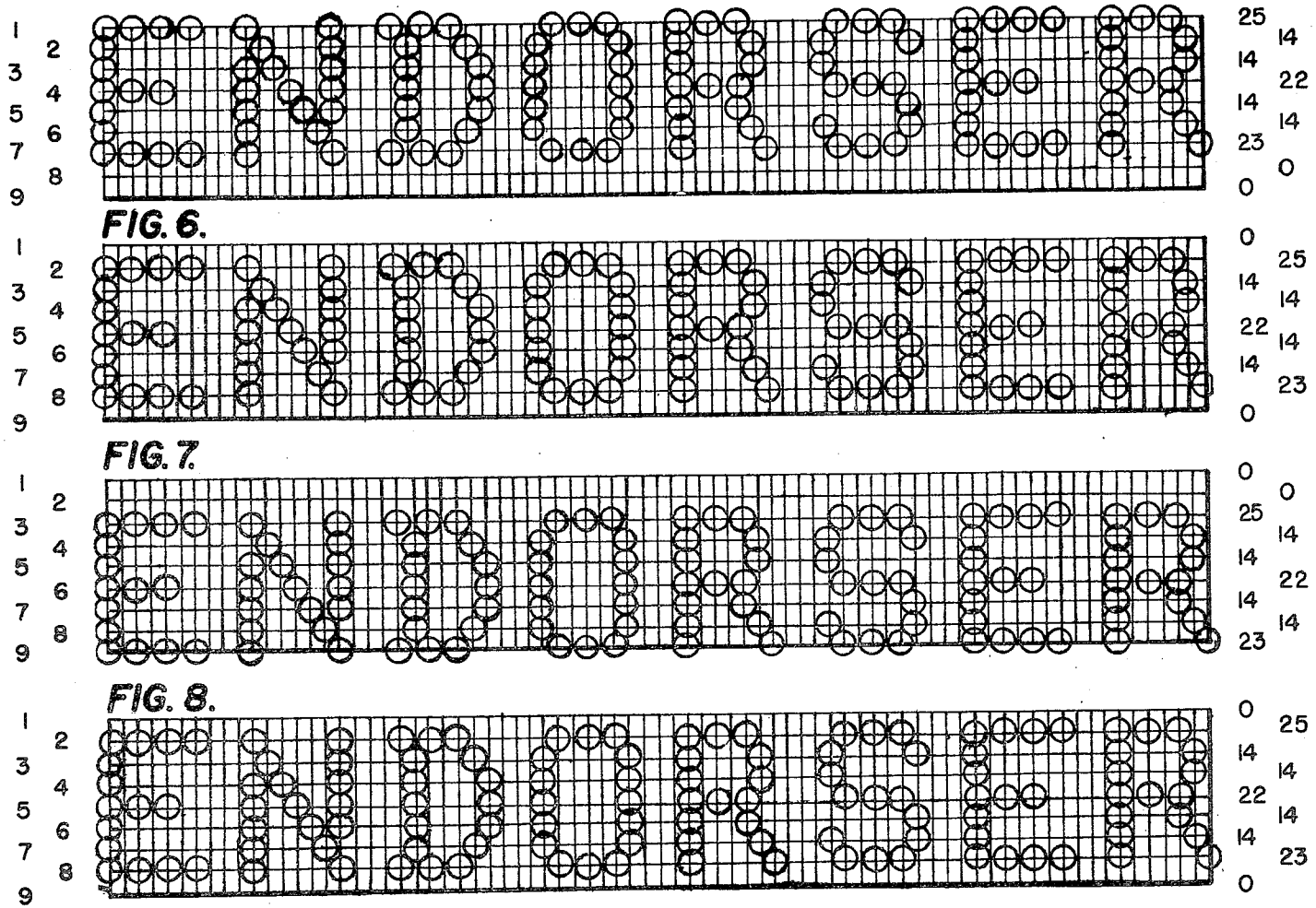
FIGS. 5–8 inclusive are diagrammatic illustrations of printing resulting from the pin shifting in accordance with the truth function table of FIG. 3.

FIGS. 5 through 8 respectively show the 1, 2, 3, 2 pin shift accomplished by the logic of FIG. 2. In these figures the sample word, Endorser, is used to obtain the impact frequency shown at the right hand edge of FIGS. 5 through 8. The impact frequency is the number of impacts that would result from the printing of the word Endorser. Note in FIG. 5 that the printing was accomplished in rows one through seven and as indicated there are no impacts in rows eight and nine. FIG. 6 has printing in rows two through eight with no printing in rows one and nine. FIG. 7 printing was accomplished in rows three through nine with no impacts in row one or two. FIG. 8 has the same printing condition as FIG. 6 with printing in rows two through eight and no printing in rows one and nine. FIG. 9, A through D, show the same totals as appear on the right hand edge of FIGS. 5 through 8 respectively. FIG. 9E sums the totals of FIG. 9, A through D, respectively. Note that the word Endorser has the maximum number of impacts on the top row of the matrix with the next highest number occuring on the bottom row of the matrix. However, as shown in FIG. 9E, with the pin shifting of the present invention the highest number of impacts occur in row five of the nine pin printing matrix printer. A review of the Alpha impact data, Pattern B indexing, which is the pattern used in FIG. 2 shows this same pin as being the high impact pin.

Now consider FIG. 10 FIG. 10 is the total impacts per row that occur with a seven pin printer (i.e., no pin shifting) when the word, Endorser is printed four consecutive times. Row one would have 25 impacts for each time the word, Endorser, is printed or 100 impacts for four printings. Each row is handled in the same fashion through the seventh row where $23 \times 4 = 92$. Now the totals of FIG. 10 can be compared to the totals of FIG. 9E. Examining FIG. 9E we can see the highest number of impacts was 72 on the fifth row of the matrix. Examining FIG. 10 we see the highest number of impacts was 100 on the top row of the matrix. Comparing FIGS. 9E and 10 show the pin shifting of the logic of FIG. 2 improves the life by 38.9% when only printing the word Endorser. However, this compares favorably with the savings based on the Alpha Frequency Table using the Pattern B indexing which is accomplished by the logic of FIG. 2 which is 38.4%.

While these results are based on one matrix type font, the trend is typical and the savings could improve further according to the matrix font configuration.

Figure 11:
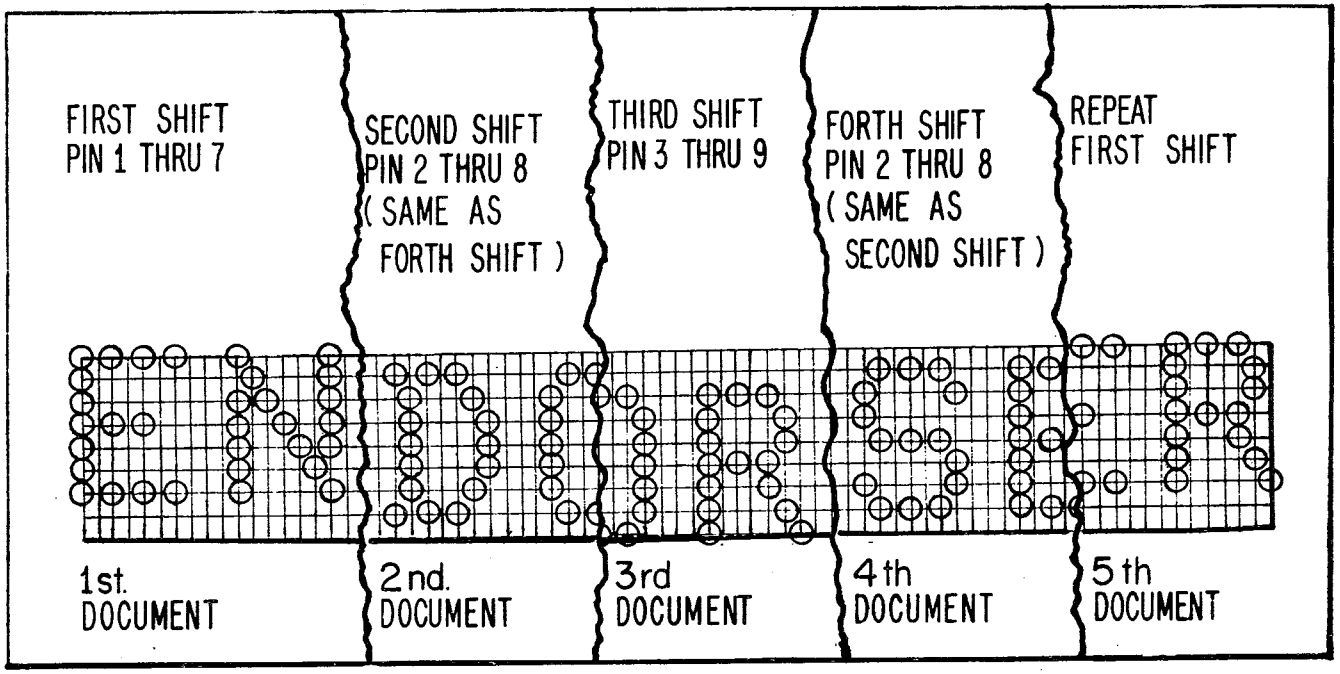
FIG. 11 is a highly stylized illustration of the print out resulting from the pin shifting technique of this invention.

FIG. 11 which is diagrammatic and not drawn to scale illustrates by means of multiple overlays the variations in position of the printing impact as a result of the pin-shifting techniques of the present invention. Visually depicted are the printed results of four shifts from the first character (first shift pins one through seven) to the fifth document which is a repeat of the first shift position printing.

FIG. 12 is a schematic illustration of an alternative pin shifting logic circuit for the present invention and is produced by means of a three shift pin shifting arrangement in accordance with the three shift truth table illustrated to this figure.

Figures 12A, 12B, 12C:
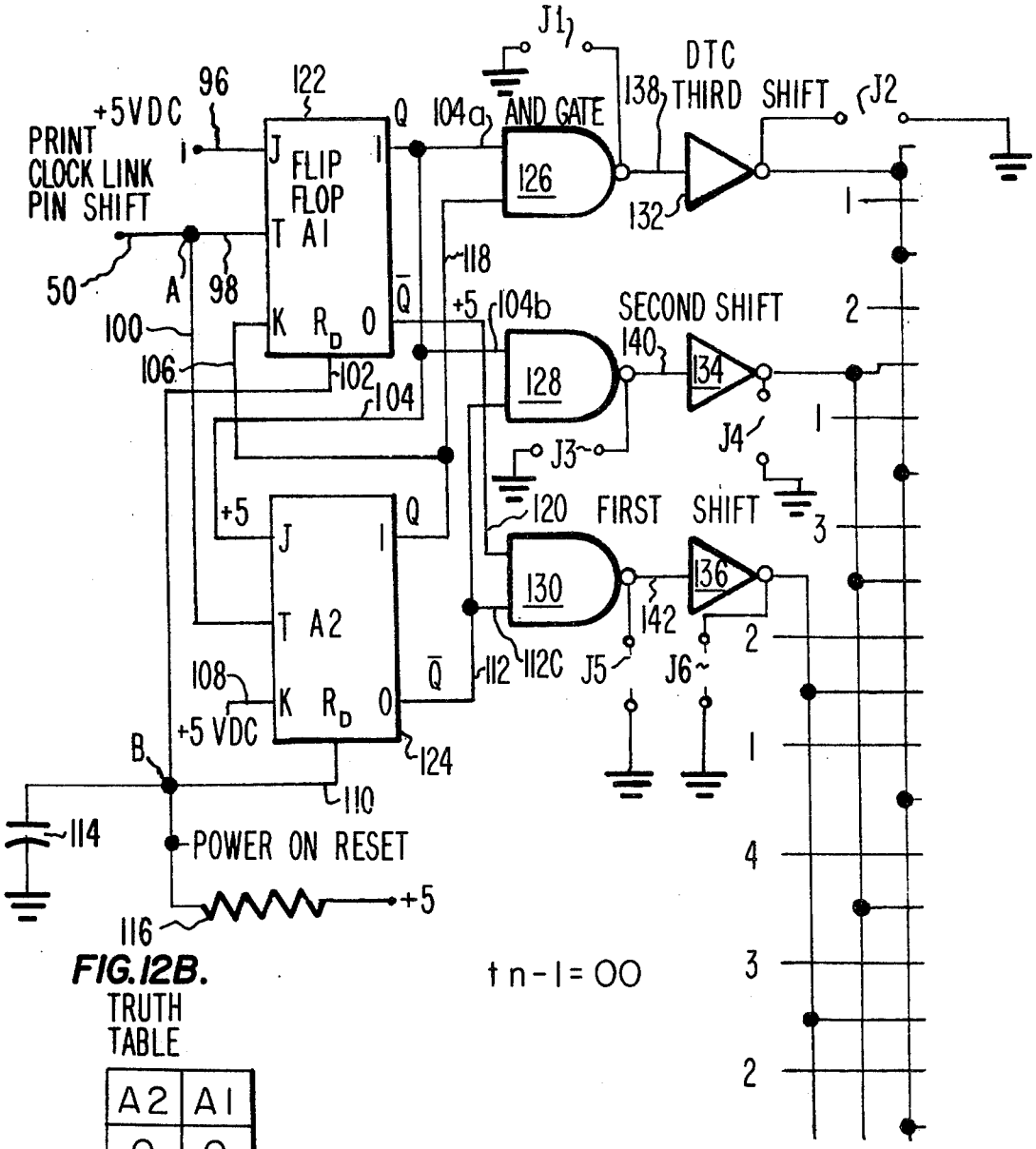

An alternative arrangement to that of FIGS. 2, 3 and 4 (four shifts) is that described herein below with reference to FIGS. 12, 12*a* and 12*b* for three shifts. The block of FIG. 12*b* utilizers jumpers one throughjumpers six. In this scheme to get the shift lock desired it is necessary to install three jumpers to control any shift lock. With those three jumpers installed there if provided the same shift lock characteristics that were described for FIG. 4. Basically it is required to cause the line that it is desired to shift, i.e., print, to go to plus five volts. The other two will go to ground. For instance, to achieve a third shift jumper J1 is grounged causing the output of the inverter 132 following J1 to go to +5. In other words, the input to the inverter is at ground and with the input at the inverter to ground the output goes to +5 volts. To assure that the second and third shift are locked out jumpers J4 and J6 are grounded. This locks the second and the first shift from printing. Thus, for third shift jumpers J1, J4 and J6 are grounded. For second shift the output of the second shift inverter 134 must be +5, therefore it's input J3 must be grounded. To assure that the third and first shift are locked out the outputs are grounded. For first shift it is required to have a +5 on the output of the first shift therefor it's input J5 must be grounded. With J5 grounded it's output is at +5 and the third and second shifts are locked out or at ground through jumpers on J2 and J4. Note that the odd numbered jumpers J1, J3 and J5 are used once in a lock out and the even jumpers J2, J4 and J6 are used twice in any sequence. Note that the J-K flip flops A1 and A2 in FIG. 12 are not tied together. In A1 and J side is tied to +5 volts DC and in A2 and K side is tied to +5 volts DC. However, the K side of A1 is tired to the 1 of Q output of A2 and the J side of A2 is tired to the 1 side of A1 or Q.

The system of FIG. 12 uses only three states of four possible states; it uses states 00, 01 and 11 as shown in FIG. 12. Notice that the state 10 is not used. In order to avoid any problems created by the situation the circuit is initialized at the beginning of a day or at turn "on" of the machine. This is done with a "power on reset". Now, this is accomplished normally by a power on reset that controls the whole machine. However, for purposes of simplicity of explanation the power on reset is shown being controlled by an RC network composed of resistor 116 and capacitor 114. Normally the capacitor, while the machine is operating, is charged to +5 volts through resistor 116 from a +5 volt power supply. However, when the machine is turned off the capacitor 114 can discharge through resistor 116 to ground. Therefore, at turn on "null B" is at ground causing flip flop 122 A1 and flip flop 124 A2 to come up to the reset condition or condition 00, FIG. 12*b*. According to the RC time constant which is not critical but before an operation can occur, the +5 volts through resistor 116 charges up capacitor 114 to a point that the reset is killed. In other words, with 5 volts on the dominant reset, FIG. 12, the reset is "off". The reset is on with ground on the dominant reset. So the circuit is first reset and then through the time constant of the RC network we have turned the reset off. This initialization takes place each time the machine is turned on. It can be seen that the machine must be off for a long enough period of time to discharge the capacitor but normally this is not considered a problem.

With the two flip flops 122 and 124 at 00 and the pin shaft operating in the same manner as it does for the logic of FIG. 2 the first document will cause a pin shift over line 50. The flop flops A1 and A2 are both at zero therefore, the Q side of A1, line 104 and the Q side of A2, 106, are both at ground. Thus, to accomplish a shift in either flip flop the J side must be high. In the case of A1 the J side is tied to +5 volts DC and a pin shift into A1, the first pin shift will cause A1 to shift from $\bar{Q}$ being high to Q being high. However, in A2 the K side is at +5 volts DC but the J side is tied to the Q output of A1 which is at ground. Therefore, A2 cannot shift and with pin shifting we get a shift in A1 and no shift in A2 or the condition 01 which is the second step as shown in the truth table.

With the truth table, FIG. 12*a*, in the state 01 now the arrangement is that the Q output of A1 is at +5 volts placing the J output of A2 at +5 volts through line 104 and 104*a*. However, the Q output of A2 is at ground holding the K output of A1 through line 106 to ground. Now, with the next pin shift A1 which already cannot change states because K is low and J which is the direction of motion allowed by pin shift is already high so that A1 will remain the same. However, A2 has a high on both sides now. The J side as earlier described through 104 will now cause the state of A2 to change and with A2 changing it will go to 1. As A1 did not change it will remain the same producing condition 11.

Now, since A1 did not change it's Q output is still high and line 104 is held high indicating that both the J and K outputs of A2 are high. However, A2 did change states and the Q output of A2 is high causing the K output of A1 to be high through line 106. In other words, the J and K inputs of both A1 and A2 are all high and another pin shift will cause both flip flops to change. This change will now take the flip flops to the 00 condition. It was not important that the J side of A2 was high or that the J side of A1 was high, the important point is that the K sides of both A1 and A2 were high to allow the change to be made. With the circuit in the 00 condition again the same sequence is repeated. The output of the flip flops A1 and A2 controls the pin shifting.

The first shifting is defined as the condition where A1, A2 equals 00, FIG. 12*a*. Now for the first shift to be true the nand gate 130 inputs must both be at +5. In other words, the $\overline{Q}$ side of flip flop 122 must be true or must be at logical 1 or +5 volts DC and the zero side of $\overline{Q}$ side of A2 which is flip flop 124 must be at logical one or +5 volts DC. With A1 $\overline{Q}$ being high line 120 is high for one input of the nand gate and when A2 or flip flop 124 $\overline{Q}$ is at +5 line 112 holds the other input to the nand gate high. When these two inputs are high the output is low. With the output of nand gate 130 being low the inverter 136 is held high by it's input through line 142 being low. A high input allows a shift condition. (Note that no two nand gates can be low at the same time.)

The second shift functions under the following conditions. With A2 being low or the $\overline{Q}$ output of 124 being at +5 volts and the Q output of A1 of flip flop 122 being at +5 volts both inputs of nand gate 128 are at +5 volts. When they are at +5 volts the output is at ground, therefore through line 140 the output of inverter 134 is held high producing a second shift condition.

The third shift is accomplished through nand gate 126 which is connected by lead 104*a* to the Q one output of flip flop 122 A1. The other input of the nand gate comes from the Q one output of flip flop 124 A2 over lead 118. Thus, when A1 is at +5 and A2 is at +5 the output of 126 is ground. Therefore, the output of inverter 132 is at +5 as the input 138 from nand gate 126 caused inverter 132 to go high. The rest of the logic will function in the same manner as described with respect to the logic of FIG. 2.

I claim:

1. Apparatus for shifting the operation of the pins or styli of a matrix pin printer so as to minimize the wear of the most used pin combination comprising, a matrix of individual styli capable of movement from a non-print to a print position and return on command, means to store a desired print font combination for causing said matrix to produce one of a number of desired printing fonts on a document as a result of a printing operation, said means to store print font information also including character generation means responsive to interrogation of intelligence carried by a document for producing characters in accordance with the data derived from said document, logic circuit means for energizing said stylii matrix in accordance with said character generation data and said stored print font information to cause said matrix to print on said document the desired character font in a given character font orientation and size, and means for altering the pin selection combination of the matrix while maintaining the same given character font orientation and size whereby the specific set of stylii for each actuation of the matrix is shifted so as to distribute the utilization of the various pins of the matrix in accordance with a prescribed, prearranged pin selection pattern.

2. The invention in accordance with claim 1 wherein the pin shifting apparatus further includes print blanking means to prevent printing during the time intervals between character selection and shifting operations.

3. The invention in accordance with claim 1 wherein said means for altering the pin selection combination further includes a pair of flip flops electrically structuredto provide one or more truth function tables for specifying the pin shifts and for causing the shifts to repeat in a desired pattern.

4. The invention in accordance with claim 1 wherein said matrix selection logic further comprises storage means providing two stable states, said storage means being operably associated with said character generation means, means for triggering said storage means in accordance with input information derived from said document, means operably associated with said storage means and said matrix for actuating the stylii of said matrix in accordance with the prearranged pin selection pattern.

5. The invention in accordance with claim 1 further including means for locking up the pin matrix in accordance with a fault lock code prescribing electrical interconnections between ground and positive potential so as to prevent pin shifting should certain pins fail to print.

6. The invention in accordance with claim 5 wherein said means for locking up the pin matrix in accordance with a fault lock code includes individual grounding busses effective when connected between ground and positive potential to prevent pin shifting should pin failure occur.

7. The invention in accordance with claim 1 wherein the pin shifting apparatus further includes electromagnetic means coupling each stylus to respective selected pin shift logic effective to print intelligence upon an item at a desired printing position.

8. The invention in accordance with claim 1 wherein said means for altering the pin selection combination further includes two different flip flop combinations to provide two truth function tables for specifying the pin shifts and for causing the shifts to repeat in a desired pattern.

9. The invention in accordance with claim 1 wherein said matrix selection logic further comprises two solid state storage means providing two stable states, said storage means being operably associated with said character generation means, means producing a reflective light path through which documents to be read are moved including a light emitting diode and a phototransistor responsive to the document passage for triggering said storage means in accordance with input information derived from said document, solid state driver means operably associated with said storage means and said matrix for actuating the stylii of said matrix in accordance with the prearranged pin selection pattern.

10. The invention in accordance with claim 1 wherein the means to store a desired print font combination comprises a read only memory for causing said matrix to produce one of a number of desired printing fonts on a document as a result of a printing operation, said read only memory means also including character generation means responsive to interrogation of intelligence carried by a document for producing characters in accordance with the data derived from said document, pin shift matrix selection logic including a plurality of electromagnetically actuated stylii for energizing said matrix in accordance with said character generation data and said printing font information to cause said matrix to print on said document the desired character font, and means for altering the pin selection combination of the matrix including a pair of flip flops providing output combinations of 00, 01 10, and 11 whereby the specific set of stylii for each actuation of the matrix is shifted according to the truth function table combination 00, 01, 10, 11 and repeat so as to distribute the utilization of the various pins of the matrix in accordance with a prescribed, prearranged pin selection pattern.

* * * * *

UNITED STATES PATENT OFFICE

CERTIFICATE OF CORRECTION

Patent No. 4,033,444 Dated July 5, 1977

Inventor(s) Jack Beery

It is certified that error appears in the above-identified patent and that said Letters Patent are hereby corrected as shown below:

Col. 3, line 69, after "8 4220" insert --9 2555--.
Col. 6, line 22, should read --ROM device 38--,
line 37, should read --apparatus 42--.
Col. 7, line 9, delete "30 5" and insert --+5--,
line 23, should read --logic 0.-- (first occurrence),
line 26, should read --herein--,
line 45, should read --86b--.
Col. 8, line 6, should read --zero volts-- (first occurrence),
line 7, should read --a first--,
line 17, should read --(one or two)-- (first occurrence),
line 21, delete "slave" (second occurrence).
Col. 9, line 47, should read --utilizes--,
line 50, should read --is provided--,
line 55, should read --grounded--.
Col. 10, line 7, should read --the J--,
line 7, should read --A2 the K--,
line 10, should read --tied--,
line 42, should read --shift--.
Col. 11, line 16, should read --shift--,
line 20, should read --side or--.

Signed and Sealed this

Fourth Day of October 1977

[SEAL]

Attest:

RUTH C. MASON
Attesting Officer

LUTRELLE F. PARKER
Acting Commissioner of Patents and Trademarks